US008083231B2

(12) United States Patent
Hirata et al.

(10) Patent No.: US 8,083,231 B2
(45) Date of Patent: Dec. 27, 2011

(54) SHEET CONVEYING APPARATUS AND IMAGE FORMING APPARATUS WITH OPENING CONVEYING PATH

(75) Inventors: Fumihiko Hirata, Toride (JP); Yuji Yamanaka, Toride (JP); Kazuhiro Kosuga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 269 days.

(21) Appl. No.: 12/469,990

(22) Filed: May 21, 2009

(65) Prior Publication Data

US 2009/0295081 A1 Dec. 3, 2009

(30) Foreign Application Priority Data

May 28, 2008 (JP) ..... 2008-139984

(51) Int. Cl.
*B65H 5/02* (2006.01)

(52) U.S. Cl. ..... 271/273; 271/274

(58) Field of Classification Search ..... 271/273, 271/274; 399/124, 125
See application file for complete search history.

(56) References Cited

U.S. PATENT DOCUMENTS 5,265,869 A * 11/1993 Morita ..... 271/274
5,300,998 A 4/1994 Ogisawa et al. ..... 355/285
5,365,321 A 11/1994 Koshimizu et al. ..... 355/285
6,145,828 A * 11/2000 Arai ..... 271/3.03
6,332,611 B1 * 12/2001 Tomita ..... 271/273
6,671,491 B1 12/2003 Yamanaka et al. ..... 399/407
6,799,008 B1 * 9/2004 Lim ..... 399/124
7,374,165 B2 * 5/2008 Agata ..... 271/248
7,809,308 B2 * 10/2010 Sekiya ..... 399/124
2008/0251999 A1 10/2008 Yamanaka et al. ..... 271/263

FOREIGN PATENT DOCUMENTS

JP 8-18724 1/1996

* cited by examiner

*Primary Examiner* — Jeremy R Severson
(74) *Attorney, Agent, or Firm* — Fitzpatrick, Cella, Harper & Scinto

(57) ABSTRACT

The present invention provides a sheet conveying apparatus and an image forming apparatus having the same, in which a jammed sheet can be easily viewed and easily removed.

A sheet conveying apparatus of the present invention comprises a fixation guide portion fixed on an apparatus body; a first guide portion disposed to face the fixation guide portion; a second guide portion disposed to face the fixation guide portion, wherein the first guide portion and the second guide portion are arranged in a line along a sheet conveying direction and each of the first guide portion and the second guide portion is independently movable; a sheet conveying path formed by the fixation guide, the first guide portion and the second guide portion, and a movement mechanism that moves the second guide portion away from the fixation guide portion, when the first guide portion is moved to open the sheet conveying path.

15 Claims, 6 Drawing Sheets

SHEET CONVEYING APPARATUS AND IMAGE FORMING APPARATUS WITH OPENING CONVEYING PATH

BACKGROUND OF THE INVENTION

1. Field of the Invention

The present invention relates to a sheet conveying apparatus having a sheet conveying path, and an image forming apparatus having the sheet conveying apparatus, such as a coping machine, a printer, and a facsimile. More particularly, the present invention relates to a technique for opening a sheet conveying path.

2. Description of the Related Art

In general, image forming apparatus, each of which includes a sheet conveying apparatus having a sheet conveying path along which a sheet is conveyed, have been known. In the sheet conveying apparatus, when a sheet is jammed on the sheet conveying path, it becomes important to easily and surely remove the jammed sheet.

The sheet conveying apparatus generally has the following configuration. In order that at least one of a pair of guide portions constituting the sheet conveying path is opened, the guide portions rotate around pivot shafts provided in the guide portions as the fulcrums.

When the sheet is jammed on the sheet conveying path, a position of the jammed sheet is informed to a user, such that the user opens the guide portion where the jammed sheet exists and removes the jammed sheet.

Accordingly, it is required to ensure an operation space that is sufficient to improve visibility of the jammed sheet and remove the jammed sheet.

As such, in order to improve a jam recovery, the rotation amount of the rotation guide portion that rotates needs to be increased. However, in the case of the sheet conveying path that is provided in the apparatus, an opening space of the rotation guide portion is not large. Accordingly, an external structure of a rotation guide portion and the rotation guide portion can be configured to rotate (for example, refer to Japanese Patent Application Publication No. 8-18724) or a rotation guide portion and a fixation guide portion are configured to be integrally drawn to the outside of the apparatus, thereby securing the rotation amount of the rotation guide portion.

However, even in any one of the above-described configurations, an opening space needs to be formed in order to open the rotation guide portion to the outside of the apparatus. Further, in order to secure the opening space, an occupied area that is needed to dispose the apparatus may be increased. In addition, even in any one of the above-described configurations, a size of a movable portion may be increased, which results in the complicated configuration of the apparatus, and the number of components may be increased, which results in increasing the manufacturing costs.

Further, even though the rotation amount of the rotation guide portion can be increased, in the vicinity of the rotation fulcrum of the rotation guide portion, the separation amount from a fixation guide portion is almost the same as that in the case where the rotation guide portion is not opened. Accordingly, when the jammed sheet exists on the sheet conveying path in the vicinity of the rotation fulcrum of the rotation guide portion, the jammed sheet is not viewed. As a result, a user may forget to remove the jammed sheet or the torn sheet piece may remain.

SUMMARY OF THE INVENTION

Accordingly, the present invention provides a sheet conveying apparatus where a jammed sheet can be easily viewed and easily removed and an image forming apparatus including the same.

A sheet conveying apparatus according to an exemplary embodiment of the present invention is a sheet conveying apparatus that comprises a fixation guide portion that is fixed on an apparatus body; a first guide portion that is disposed to face the fixation guide portion; a second guide portion that is disposed to face the fixation guide portion, wherein the first guide portion and the second guide portion are arranged in a line along a sheet conveying direction and each of the first guide portion and the second guide portion is independently movable; a sheet conveying path formed by the fixation guide, the first guide portion and the second guide portion, and a movement mechanism that moves the second guide portion away from the fixation guide portion, when the first guide portion is moved to open the sheet conveying path.

An image forming apparatus according to another exemplary embodiment of the present invention includes an image forming portion that forms an image on a sheet and the sheet conveying apparatus that conveys the sheet to the image forming portion.

According to the present invention, since the second guide portion moves in a direction that is away from the fixation guide portion by the movement mechanism, it is possible to improve visibility of the sheet jammed on the sheet conveying path, even though the rotation amount of the first guide portion is not set to a large value. In addition, when the jammed sheet is removed, the sheet can be easily removed.

Further features of the present invention will become apparent from the following description of exemplary embodiments with reference to the attached drawings.

BRIEF DESCRIPTION OF THE DRAWINGS

FIG. 4A is a diagram illustrating a state where an opening/closing guide portion is closed. FIG. 4B is a diagram illustrating a state where an opening/closing guide portion is being opened. FIG. 4C is a diagram illustrating a state where an opening/closing guide portion is being opened. FIG. 4D is a diagram illustrating a state where an opening/closing guide portion is opened.

FIG. 5A is a diagram illustrating a state where an opening/closing guide portion is closed. FIG. 5B is a diagram illustrating a state where an opening/closing guide portion is being opened. FIG. 5C is a diagram illustrating a state where an opening/closing guide portion is being opened. FIG. 5D is a diagram illustrating a state where an opening/closing guide portion is opened.

FIG. 6A is a diagram illustrating a state where an opening/closing guide portion is closed. FIG. 6B is a diagram illustrating a state where an opening/closing guide portion is opened.

DESCRIPTION OF THE EMBODIMENTS

Hereinafter, exemplary embodiments of the present invention will be described in detail with reference to the accompanying drawings.

First Embodiment

Figure 1:
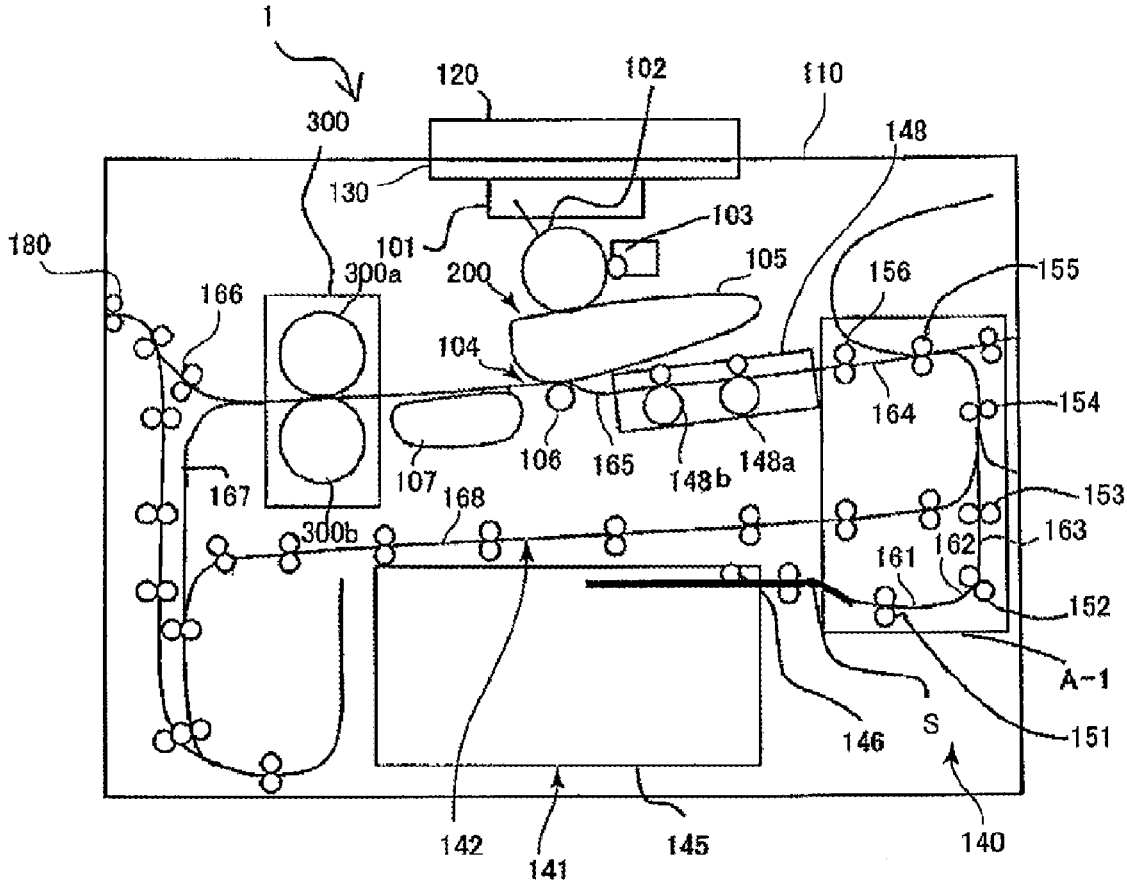
FIG. 1 is a diagram illustrating the schematic configuration of a printer that is an example of an image forming apparatus where a sheet conveying apparatus according to a first embodiment of the present invention is mounted.

FIG. 1 is a diagram illustrating the schematic configuration of a printer that is an example of an image forming apparatus where a sheet conveying apparatus according to a first embodiment is mounted.

In FIG. 1, a printer 1 serves as an image forming apparatus, and a printer body 110 serves as an image forming apparatus body that is also a body of a sheet conveying apparatus.

The printer 1 includes an original base feeding device 120 that is disposed on the printer body 110 and an image reading portion 130 that reads out an original base loaded on an original placing platen (not illustrated). Further, the printer 1 includes a sheet conveying apparatus 140 that conveys a sheet S, an image forming portion 200 that forms an image on the sheet S conveyed by the sheet conveying apparatus 140, and a fixing portion 300 that fixes a toner image formed by the image forming portion 200 on the sheet.

The sheet conveying apparatus 140 includes a sheet feeding portion 141 that feeds the sheet S, a sheet conveying path 142 along which the sheet S is conveyed, and a skew feeding correcting mechanism 148 serving as a skew feeding correcting portion that performs skew feeding correction or timing correction of the sheet S. Further, the sheet conveying apparatus 140 includes a plurality of conveying roller pairs 151 to 156 that are disposed on the sheet conveying path 142. Further, the sheet conveying apparatus 140 includes a discharge roller pair 180 that discharges the sheet S where an image is fixed by the fixing portion 300 from the printer body 110.

The sheet conveying path 142 has a horizontal path 161 serving as a horizontal portion that extends in an approximately horizontal direction from the sheet feeding portion 141, and a first curvature path 162 that is bent to extend upward in an approximately vertical direction from the horizontal path 161 and has a downward convex shape. Further, the sheet conveying path 142 has a vertical path 163 that extends upward in a substantially vertical direction from the first curvature path 162, and an inclination path 164 that extends downward in an oblique direction from the vertical path 163. Further, the sheet conveying path 142 has a second curvature path 165 that is bent to extend upward in an oblique direction from the inclination path 164 and has a downward convex shape. In this case, the downward convex shape includes a shape in the case where the path is inclined in a downward direction as well as a shape in the case where a convex portion faces directly below.

The conveying roller pair 151 is disposed on the horizontal path 161, the conveying roller pair 152 is disposed on the first curvature path 162, and the conveying roller pairs 153 and 154 are disposed on the vertical path 163. Further, the conveying roller pairs 155 and 156 and the skew feeding correcting mechanism 148 are disposed on the inclination path 164.

Further, the sheet conveying path 142 has a straight path 166 that directly discharges the sheet S from the fixing portion 300 and an inversion path 167 that switches back the sheet S. Further, the sheet conveying path 142 has a reconveying path 168 that is connected to an intermediate portion of the vertical path 163, joins the sheet S switched back by the inversion path 167 to the upstream side of the conveying roller pair 154, and guides the sheet S to the image forming portion 200 again.

The skew feeding correcting mechanism 148 uses a so-called active registration system that corrects skew feeding of the sheet S while conveying the sheet S. The skew feeding correcting mechanism 148 has two skew feeding correcting roller pairs 148*a* and 148*a* that are disposed in the sides in a width-wise direction orthogonal to a sheet conveying direction, and two horizontal registration roller pairs 148*b* and 148*b* that are disposed in the sides in a width-wise direction. In FIG. 1, only one of each of the skew feeding correcting roller pairs and the horizontal registration roller pairs is illustrated. The skew feeding correcting roller pairs 148*a* and 148*a* independently rotate. At this time, the skew feeding correcting roller pairs 148*a* and 148*a* rotate at different conveying speeds, respectively. The horizontal registration roller pairs 148*b* and 148*b* are configured to be slid in a width-wise direction. The conveying speed is set to each of the skew feeding correcting roller pairs 148*a* and 148*a* in accordance with the skew feeding amount of the sheet S. As a result, the sheet S is subjected to skew feeding correction while being conveyed by each of the skew feeding correcting roller pairs 148*a* and 148*a*. Further, the horizontal registration of the sheet S is corrected by the horizontal registration roller pairs 148*b* and 148*b*.

The image forming portion 200 has a photosensitive drum 102 that is disposed on the downstream side of the sheet conveying direction of the skew feeding correcting mechanism 148 and serves as an image bearing member, a transfer portion 104 that transfers a toner image to the sheet S, an exposure device 101, a development device 103, and a charge device (not illustrated).

The transfer portion 104 has a transfer belt 105 that is stretched by rollers such as a driving roller, a tension roller, and a transfer counter roller (which are not illustrated in the drawings) and is conveyed, and a transfer roller 106 that is welded into the transfer belt 105 with pressure by the transfer counter roller (not illustrated). The transfer roller 106 is welded into the transfer belt 105 with pressure, thereby forming a transfer nip portion.

The sheet feeding portion 141 has a cassette 145 serving as a sheet storage portion that stores a plurality of sheets S, and a separation roller 146 that discharges the sheets S stored in the cassette 145. The various sheets S can be selectively stored in the cassette 145.

In the printer 1 that has the above-described configuration, if an image read signal is output to the image reading portion 130 from a control device (not illustrated) that is provided in the printer body 110, an image is read by the image reading portion 130.

In addition, the surface of the photosensitive drum 102 is uniformly charged by the charge device (not illustrated). Next, an electrostatic latent image is formed on the surface of the photosensitive drum 102 by an exposure by the exposure device 101. Then, the development device 103 performs a toner development on the electrostatic latent image that is formed on the photosensitive drum 102, and a toner image is formed on the photosensitive drum 102. Then, the toner image is transferred to the transfer belt 105.

Further, a cleaning member (not illustrated) that cleans the toner or paper powders abuts the surfaces of the transfer belt 105 and the photosensitive drum 102 and cleans the individual surfaces.

Meanwhile, if a paper feeding signal is output from the control device to the sheet feeding portion 141, each sheet S is sequentially discharged from the cassette 145 where the sheets S each having a designated size are stored, by means of the separation roller 146. In addition, the discharged sheet S is conveyed to the skew feeding correcting mechanism 148 by the conveying roller pairs 151 to 156, and the skew feeding of the sheet S is corrected by the skew feeding correcting mechanism 148.

Next, the sheet S where the skew feeding has been corrected is conveyed up to the transfer nip portion of the transfer belt 105 and the transfer roller 106.

The sheet S where the toner image has been transferred by the transfer belt 105 and the transfer roller 106 is conveyed to the fixing portion 300 by a conveyer belt 107. In addition, in the fixing portion 300, the toner is melted and fixed on the sheet by heat and pressure from rollers 300*a* and 300*b* that substantially face each other.

Next, the sheet S that has a fixation image obtained in the above-described way passes through the straight path 166 and is then discharged to a sheet post-processing device (not illustrated) by means of the discharge roller pair 180.

Further, when an image is formed on both surfaces of the sheet S, the sheet S is conveyed to the inversion path 167 by a switching member (not illustrated). If the sheet S is conveyed to the inversion path 167, the front and rear ends of the sheet S are switched by the switching back operation and the sheet S is conveyed to the reconveying path 168.

Then, the sheet S is joined to an intermediate portion of the vertical path 163 by adjusting timing with the sheet S of the following job that is conveyed from the sheet feeding portion 141, and is transmitted to the image forming portion 200 via the conveying roller pairs 154 to 156 and the skew feeding correcting mechanism 148. Since the image forming process is the same as that in the first surface, the description thereof will be omitted.

Next, the sheet conveying apparatus 140 of the printer 1 according to the first embodiment will be described in detail.

Figure 2:
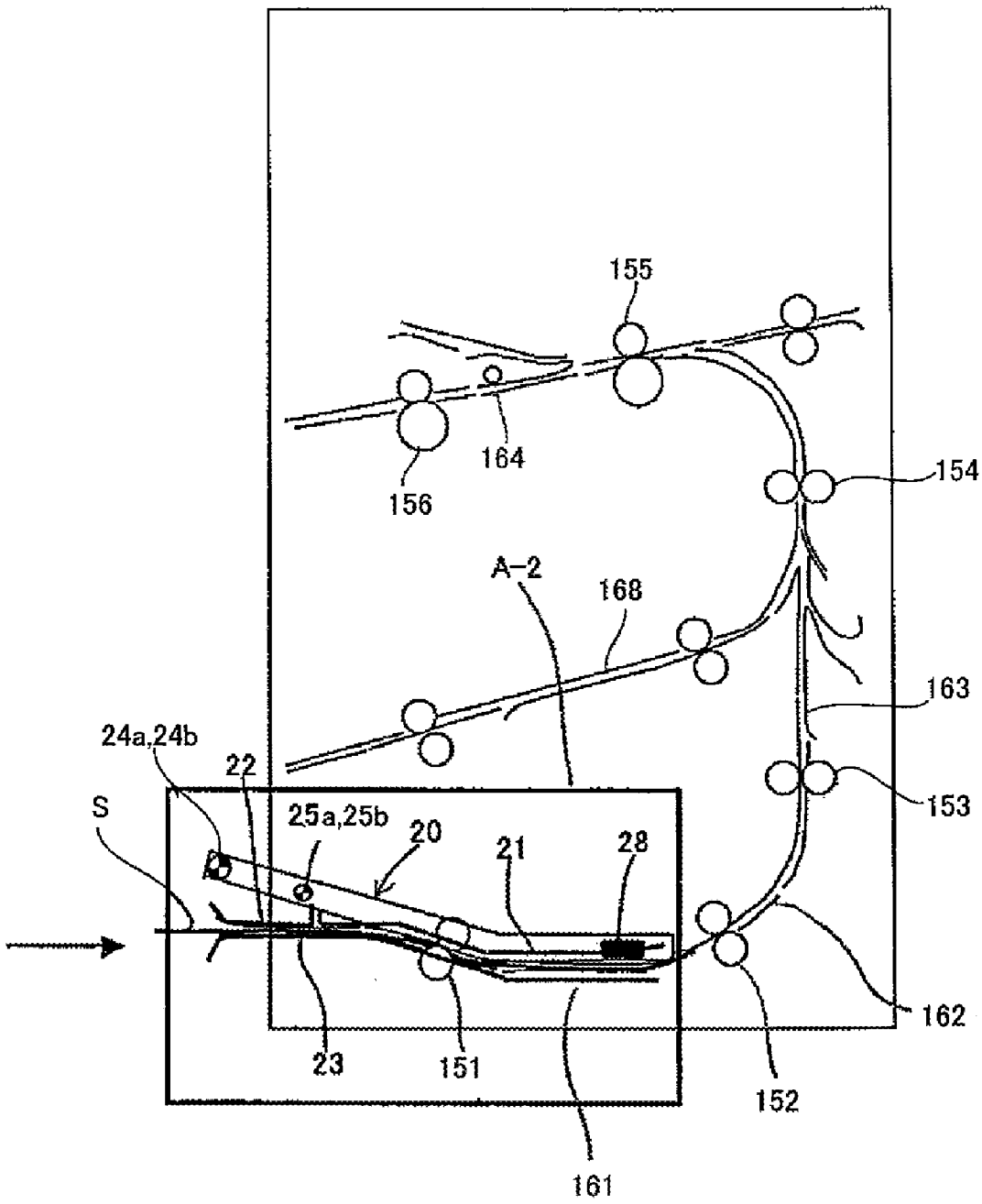
FIG. 2 is a partial enlarged view illustrating the schematic configuration of an A-1 portion of FIG. 1 in a printer.
Figure 3A:
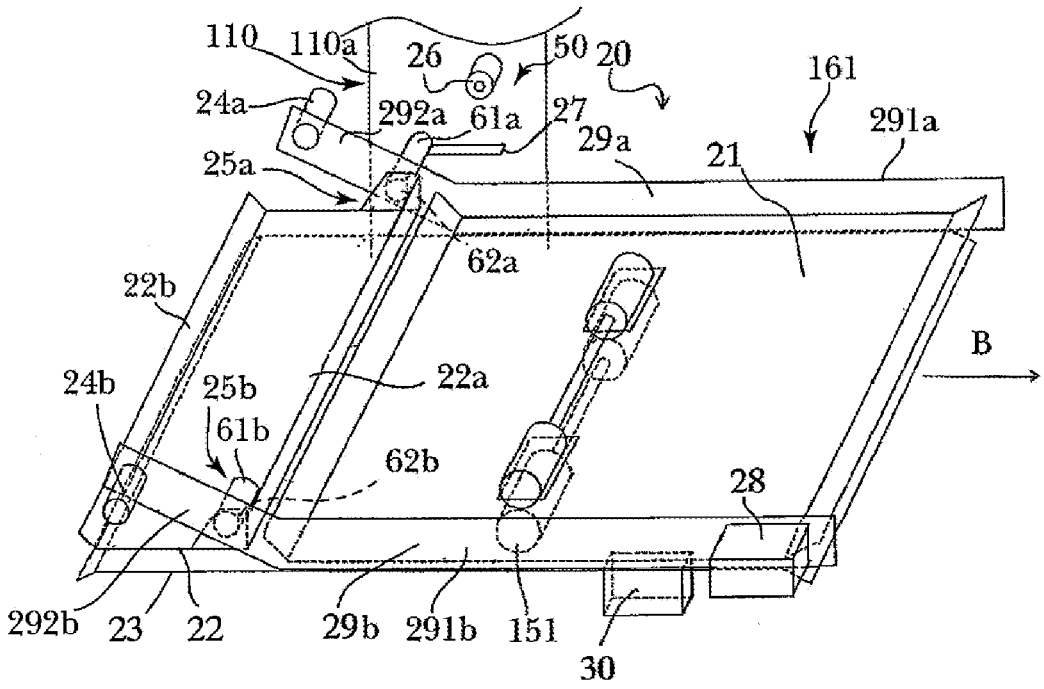
FIG. 3A is a perspective view illustrating the schematic configuration of a horizontal path in an A-2 portion of FIG. 2.
Figure 3B:
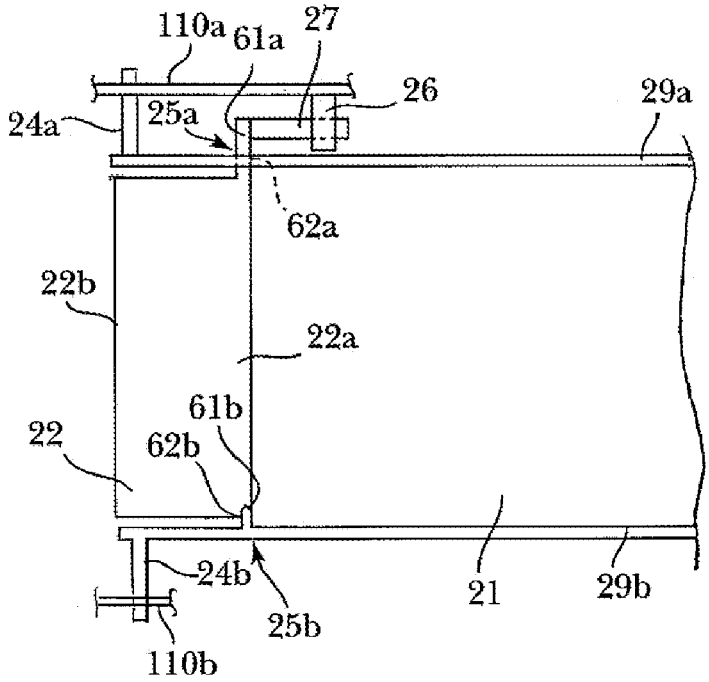
FIG. 3B is a partial plan view illustrating the schematic configuration of a horizontal path in an A-2 portion of FIG. 2.

FIG. 2 is a partial enlarged view illustrating the schematic configuration of an A-1 portion of FIG. 1 in a printer 1. FIG. 3A is a perspective view illustrating the schematic configuration of a horizontal path 161 in an A-2 portion of FIG. 2. FIG. 3B is a partial plan view illustrating the schematic configuration of a horizontal path 161 in an A-2 portion of FIG. 2.

The horizontal path 161 of the sheet conveying path 142 has a fixation guide portion 23 that is fixed on the printer body 110 in an approximately horizontal state, and an opening/closing guide portion 20 that is disposed to face the fixation guide portion 23 and can be opened and closed. The opening/closing guide portion 20 has a first guide portion 21 that is disposed to face the fixation guide portion 23 above the fixation guide portion 23. Further, the opening/closing guide portion 20 has a second guide portion 22 that is disposed to face the fixation guide portion 23 on the upstream side of a sheet conveying direction (direction illustrated by an arrow B) of the first guide portion 21, and connected to the first guide portion 21.

In one end of the first guide portion 21 in a width-wise direction that is orthogonal to the sheet conveying direction, an arm 29*a* that serves as a holding portion is provided. In the other end of the first guide portion 21, an arm 29*b* is provided. By the arms 29*a* and 29*b*, the first guide portion 21 is supported to be freely inclined.

One arm 29*a* has a fixing portion 291*a* that is fixed on one end of the first guide portion 21, and an extending portion 292*a* that extends to the upstream side of the sheet conveying direction from the fixing portion 291*a* and is bent in a direction away from the fixation guide portion 23. Further, the other arm 29*b* has a fixing portion 291*b* that is fixed on the other end of the first guide portion 21, and an extending portion 292*b* that extends to the upstream side of the sheet conveying direction from the fixing portion 291*b* and is bent in a direction away from the fixation guide portion 23.

On the end of the arm 29*a* at the upstream side of the sheet conveying direction, that is, the end of the extending portion 292*a*, a rotation shaft 24*a* that is supported to freely rotate by one frame 110*a* of the printer body 110 in a width-wise direction is fixed. That is, the arm 29*a* is supported to freely rotate by the frame 110*a* in the apparatus body. Further, on a front end of the arm 29*b* at the upstream side of the sheet conveying direction, that is, a front end of the extending portion 292*b*, a rotation shaft 24*b* that is supported to freely rotate by the other frame 110*b* of the printer body 110 in a width-wise direction is fixed. The rotation shafts 24*a* and 24*b* are disposed at the locations that face the fixation guide portions 23.

As a result, the arms 29*a* and 29*b* are supported by the printer body 110 to rotate integrally with the first guide portion 21 around the rotation shafts 24*a* and 24*b* as fulcrums. In addition, if the arms 29*a* and 29*b* are rotated, the first guide portion 21 can be opened and closed. The arm 29*b* is provided with a handle 28 that allows a user to open/close the first guide portion 21.

Further, one roller of the conveying roller pair 151 is provided at the side of the fixation guide portion 23, and the other roller is provided at the side of the first guide portion 21. When the first guide portion 21 is opened, the conveying roller pair 151 moves integrally with the first guide portion 21.

The second guide portion 22 is disposed in the vicinity of the rotation shafts 24*a* and 24*b* as the rotation fulcrums of the arms 29*a* and 29*b*. In addition, the first guide portion 21 and the second guide portion 22 is held by a spacer (not illustrated) and a closing magnet 30 so as to maintain a distance of about 3 mm with respect to the fixation guide portion 23 as a conveyance space of the sheet S.

In the first embodiment, the printer 1 includes a movement mechanism 50 that moves the second guide portion 22 in a direction away from the fixation guide portion 23, when the first guide portion 21 is opened by rotating the arms 29*a* and 29*b*.

The movement mechanism 50 has a supporting portion 25*a* that is provided on one side of one end 22*a* as the sheet conveying direction downstream side end of the second guide portion 22 in a width-wise direction, and supports one end 22*a* to rotate with respect to the arm 29*a*. Further, the movement mechanism 50 has a supporting portion 25*b* that is provided on the other side of one end 22*a* of the second guide portion 22 in a width-wise direction, and supports one end 22*a* to rotate with respect to the arm 29*b*. That is, the arms 29*a* and 29*b* that serve as the holding portions hold the first guide portion 21 and the second guide portion 22. The second guide portion 22 is held by the supporting portions 25*a* and 25*b* provided in the arms 29*a* and 29*b* to freely move with respect to the arms 29*a* and 29*b*.

One supporting portion 25*a* includes a rotation shaft 61*a* that is fixed on one side of one end 22*a* of the second guide portion 22 in a width-wise direction and protrudes to the frame 110*a*, and a bearing 62*a* that is formed in the arm 29*a* and penetrated by the rotation shaft 61*a*.

Further, the other supporting portion 25*b* includes a rotation shaft 61*b* that is fixed on the arm 29*b* and protrudes to the second guide portion 22, and a bearing 62*b* that is formed on the other side of one end 22*a* of the second guide portion 22 in a width-wise direction and penetrated by the rotation shaft 61*b*.

Further, the movement mechanism 50 has a lever 27 serving as an abutment portion that is provided in one end 22*a* of the second guide portion 22. The lever 27 is attached to the rotation shaft 61*a* that is fixed on one end 22*a* of the second guide portion 22. The lever 27 is disposed opposite to a direction that is parallel to the sheet conveying direction of the second guide portion 22 with the rotation shaft 61*a* interposed therebetween. In addition, when the lever 27 becomes a point of force, a pressing force is applied to the lever 27, and the lever 27 rocks, the second guide portion 22 rotates around the rotation shaft 61*a*. Further, since the first guide portion 21 is disposed inside the arm 29*a*, the lever 27 is disposed outside the arm 29*a*.

Further, the movement mechanism 50 has an abutment member 26 serving as an abutted portion that is disposed on the lever 27 and fixed on the frame 110*a* and the lever 27 can abut.

In the first embodiment, each of the rotation shafts 61*a* and 61*b* is provided with a torsion coil spring (not illustrated). One end of the torsion coil spring is locked to the arms 29*a* and 29*b* and the other end thereof is locked to the second guide portion 22. As a result, a force is always applied to the first guide portion 21 by the spring in a counterclockwise direction in the drawings, but the second guide portion 22 is regulated by a stopper (not illustrated), such that the second guide portion 22 is parallel to the first guide portion 21.

Next, the opening operation of the opening/closing guide portion 20 when the sheet S is jammed on the horizontal path 161 will be described.

Figure 4A:
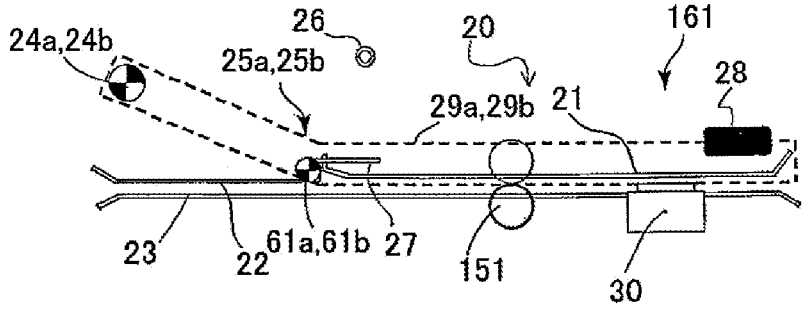
FIGS. 4A to 4D are diagrams illustrating an opening operation of a horizontal path.
Figure 4B:
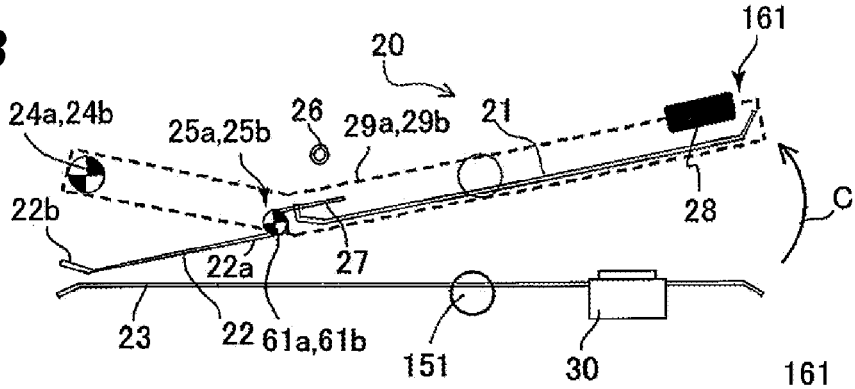
Figure 4C:
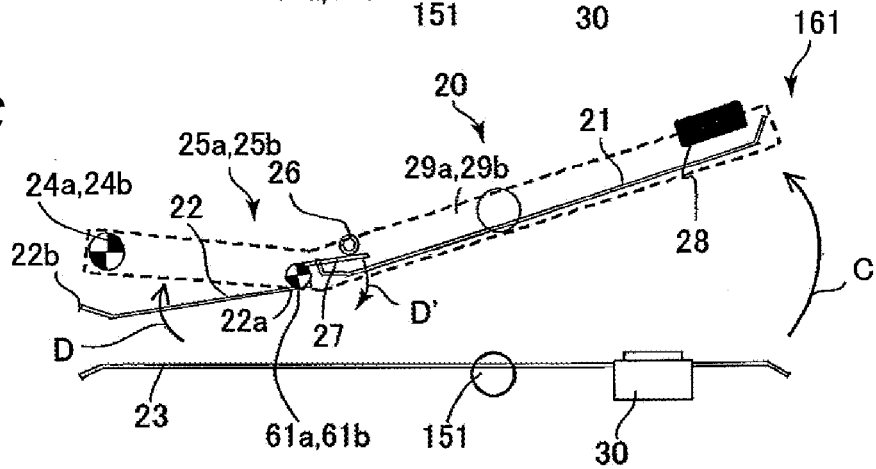
Figure 4D:
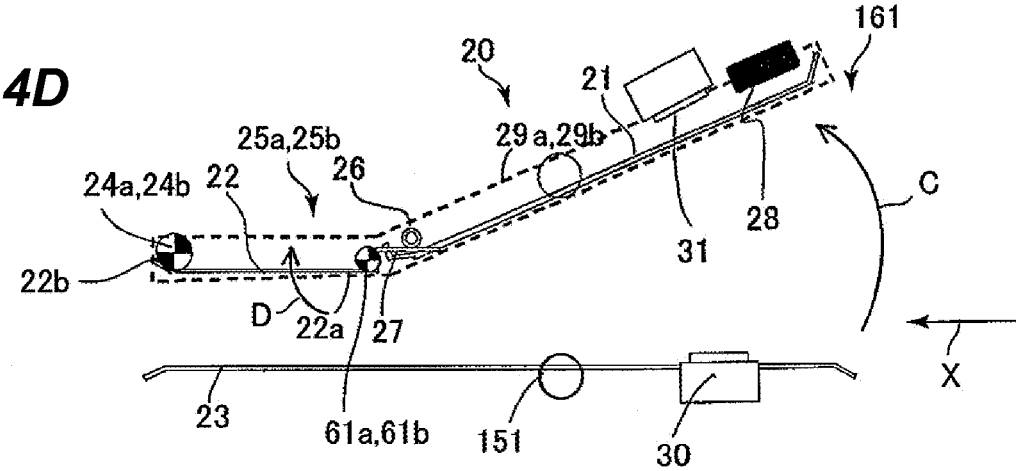

FIGS. 4A to 4D are diagrams illustrating an opening operation of a horizontal path 161. FIG. 4A is a diagram illustrating a state where an opening/closing guide portion 20 is closed. FIG. 4B is a diagram illustrating a state where an opening/closing guide portion 20 is being opened. FIG. 4C is a diagram illustrating a state where an opening/closing guide portion 20 is being opened. FIG. 4D is a diagram illustrating a state where an opening/closing guide portion 20 is opened.

First, in a state where the opening/closing guide portion 20 is closed, as illustrated in FIG. 4A, the first guide portion 21 and the second guide portion 22 are held at a predetermined distance (3 mm) from the fixation guide portion 23.

As illustrated in FIG. 4B, when the user raises the handle 28 and rotates the arms 29*a* and 29*b*, the opening/closing guide portion 20 deviates from the closing magnet 30. In addition, the arms 29*a* and 29*b* rotate around the rotation shafts 24*a* and 24*b* as the fulcrums in a direction illustrated by an arrow C (counterclockwise direction), and are inclined in a direction where the first guide portion 21 and the second guide portion 22 are integrally opened (direction away from the fixation guide portion 23). At this time, since one end 22*a* of the second guide portion 22 is supported by the supporting portions 25*a* and 25*b*, the second guide portion 22 is linked with the arms 29*a* and 29*b* and moves in a direction away from the fixation guide portion 23. Further, since a force is applied to the second guide portion 22 by the torsion coil spring (not illustrated), the second guide portion 22 is inclined together with the first guide portion 21 while being maintained in a state where the second guide portion 22 is parallel to the first guide portion 21 by means of the application force.

Further, if the user rotates the arms 29*a* and 29*b*, as illustrated in FIG. 4C, the lever 27 abuts the abutment member 26. In this state, if the user further rotates the arms 29*a* and 29*b*, the lever 27 is pressed by the abutment member 26, and rotates around the rotation shaft 61*a* of the supporting portions 25*a* and 25*b* as the fulcrum in a direction illustrated by an arrow D' (clockwise direction).

As a result, the second guide portion 22 is against the application force of the torsion coil spring (not illustrated), and rotates around the rotation shafts 61*a* and 61*b* of the supporting portions 25*a* and 25*b* as the fulcrums in a direction illustrated by an arrow D (clockwise direction) that is opposite to the direction illustrated by the arrow C relatively with respect to the first guide portion 21. That is, the second guide portion 22 rotates around the rotation shafts 61*a* and 61*b* as the fulcrums in a direction where the other end 22*b* of the second guide portion 22 is away from the fixation guide portion 23.

In addition, when the opening/closing guide portion 20 is maximally opened, as illustrated in FIG. 4D, the entire second guide portion 22 is away from the fixation guide portion 23. The opening/closing guide portion 20 is absorbed into the opening and maintaining magnet 31 that is disposed to face the fixation guide portion 23, and the opened state thereof is maintained.

As such, when the first guide portion 21 is inclined and opened, the second guide portion 22 in the vicinity of the rotation fulcrum of the first guide portion 21 moves in a direction that is away from the fixation guide portion 23. In addition, when the user views the horizontal path 161 in a direction illustrated by an arrow X from the side of the first guide portion 21, since the second guide portion 22 that is disposed inside the first guide portion 21 is away from the fixation guide portion 23, the jammed sheet S can be easily viewed. Accordingly, even though the rotation amount of the first guide portion 21 is not set to a large value, it is possible to improve visibility of the jammed sheet S. Further, even when the jammed sheet S is removed, the second guide portion 22 moves in a direction away from the fixation guide portion 23. Accordingly, a work space is ensured, and the sheet S can be easily removed.

Further, since the opening/closing guide portion 20 can be absorbed into the opening and maintaining magnet 31 and this state can be maintained, the user can perform a jam recovery using both hands, which results in improving work efficiency.

Further, since the arms 29*a* and 29*b* are formed to be bent, the arms 29*a* and 29*b* move in a direction where the extending portions 292*a* and 292*b* of the arms 29*a* and 29*b* are away from the fixation guide portion 23, when the opening/closing guide portion 20 is opened. Accordingly, when the user inserts his or her hand from any one of both sides in the width-wise direction (direction orthogonal to the direction illustrated by the arrow X) and performs a jam recovery, the user is not disturbed by the arms 29*a* and 29*b*. Accordingly, the user can easily remove the sheet S.

Further, since the rotation amount of the opening/closing guide portion 20, that is, the rotation amount of the first guide portion 21 is decreased, it is not necessary to increase the opening space in the printer body 110. Therefore, the apparatus can be miniaturized. Further, the apparatus structure can be simplified, and the manufacturing costs can be reduced.

Further, in the first embodiment, the case where the arms 29*a* and 29*b* are formed to be bent has been described, but the present invention is not limited thereto.

Figure 5A:
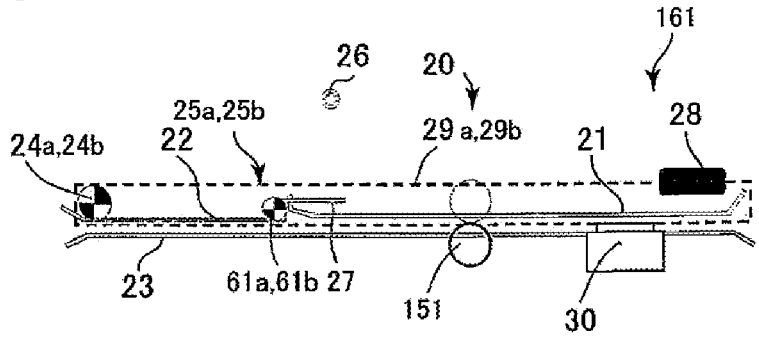
FIGS. 5A to 5D are diagrams illustrating a modification of a printer that is an example of an image forming apparatus where a sheet conveying apparatus according to the first embodiment is mounted.
Figure 5B:
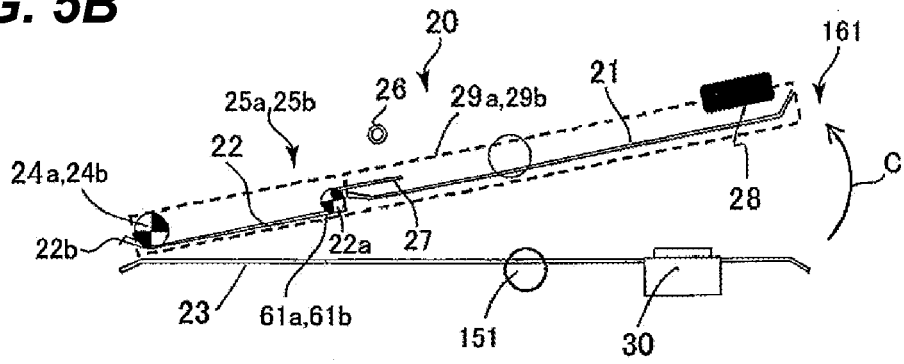
Figure 5C:
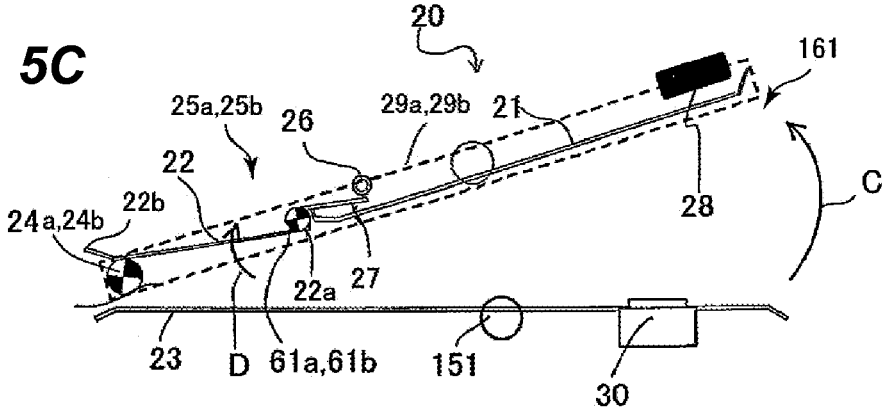
Figure 5D:
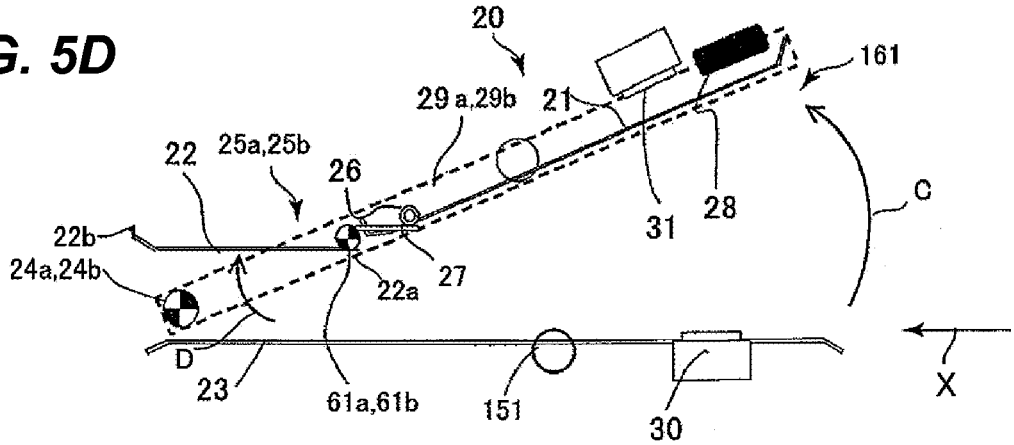

FIGS. 5A to 5D are diagrams illustrating a modification of a printer that is an example of an image forming apparatus where a sheet conveying apparatus according to a first embodiment is mounted. FIG. 5A is a diagram illustrating a state where an opening/closing guide portion 20 is closed. FIG. 5B is a diagram illustrating a state where an opening/closing guide portion 20 is being opened. FIG. 5C is a diagram illustrating a state where an opening/closing guide portion 20 is being opened. FIG. 5D is a diagram illustrating a state where an opening/closing guide portion 20 is opened.

As illustrated in FIGS. 5A to 5D, each of the arms 29*a* and 29*b* has a straight shape. Further, the opening operation is the same as the opening operation that has been described with reference to FIG. 4. As illustrated in FIG. 5A, if the opening/closing guide portion 20 in a closed state is raised, the first guide portion 21 and the second guide portion 22 are integrally inclined, as illustrated in FIG. 5B. In addition, as illustrated in FIG. 5C, if the lever 27 abuts the abutment member 26, the other end 22*b* of the second guide portion 22 moves in a direction away from the fixation guide portion 23, as illustrated in FIG. 5D. As a result, the entire second guide portion 22 becomes away from the fixation guide portion 23.

Even in this case, similar to the above case, when the horizontal path 161 is viewed in the direction illustrated by the arrow X from the side of the first guide portion 21, since the second guide portion 22 that is disposed inside the first guide portion 21 is away from the fixation guide portion 23, the jammed sheet S can be easily viewed. Accordingly, even though the rotation amount of the first guide portion 21 is not set to a large value, it is possible to improve visibility of the jammed sheet S. Further, even when the jammed sheet S is removed, the second guide portion 22 moves in a direction away from the fixation guide portion 23. Accordingly, a work space is ensured, and the sheet S can be easily removed.

Second Embodiment

In the first embodiment, the case where the movement mechanism 50 has the supporting portions 25*a* and 25*b*, the abutment member 26, and the lever 27 has been described. In the second embodiment, an image forming apparatus where the configuration of the movement mechanism is different will be described. In this case, the same components as those in the first embodiment are denoted by the same reference numerals, and the description thereof will be omitted.

Figure 6A:
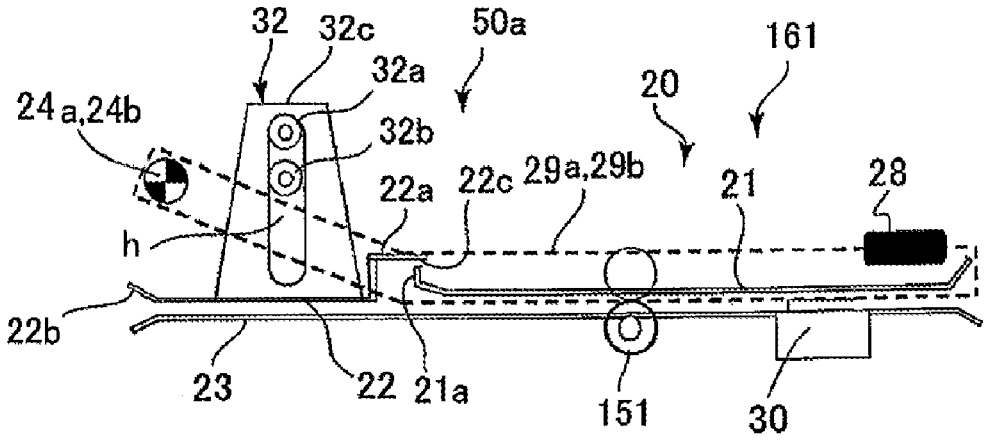
FIGS. 6A and 6B are diagrams illustrating the schematic configuration of a printer that is an example of an image forming apparatus where a sheet conveying apparatus according to a second embodiment is mounted.
Figure 6B:
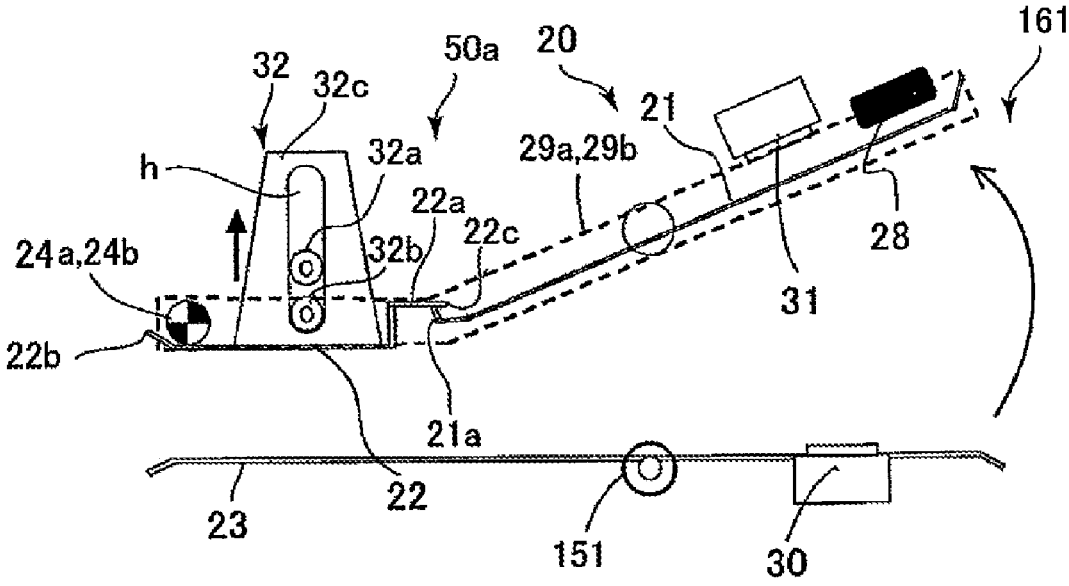

FIGS. 6A and 6B are diagrams illustrating the schematic configuration of a printer that is an example of an image forming apparatus where a sheet conveying apparatus according to a second embodiment is mounted. FIG. 6A is a diagram illustrating a state where an opening/closing guide portion 20 is closed. FIG. 6B is a diagram illustrating a state where an opening/closing guide portion 20 is opened.

In the second embodiment, a movement mechanism 50*a* has a bent portion 21*a* that serves as a guide abutment portion provided in an end of the first guide portion 21 at the side of the second guide portion 22 and is bent in an approximately L shape. Further, the movement mechanism 50*a* has an abutted surface 22*c* serving as a guide abutted portion that is provided in one end 22*a* of the second guide portion 22 and the bent portion 21*a* can abut.

Further, the movement mechanism 50*a* has a guide portion 32 that guides the second guide portion 22 such that the second guide portion 22 is slid in a direction away from the fixation guide portion 23, when the bent portion 21*a* serving as an abutment portion abuts the abutted surface 22*c*. The guide portion 32 has a pair of guide shafts 32*a* and 32*b* that are installed in the printer body serving as the apparatus body, and a guide member 32*c* that is fixed on the second guide portion 22 and has an elongated hole h where the pair of guide shafts 32*a* and 32*b* are inserted. That is, the second guide portion 22 is supported to be slid in the apparatus body, by the pair of guide shafts 32*a* and 32*b* serving as slide supporting portions that are provided in the apparatus body.

The pair of guide shafts 32*a* and 32*b* are provided above (outside) the second guide portion 22 to be parallel in an up-to-down direction (direction vertical to a guide surface). As a result, the guide member 32*c* is guided to the pair of guide shafts 32*a* and 32*b* that are inserted into the elongated hole h. The second guide portion 22 where the guide member 32*c* is fixed is guided in a direction away from the fixation guide portion 23 while being maintained in a state where the second guide portion 22 is parallel to the fixation guide portion 23.

In this case, in the second embodiment, a spring (not illustrated) is provided, which applies a force in a direction where the second guide portion 22 is closed. When the second guide portion 22 moves in a direction away from the fixation guide portion 23, the second guide portion 22 moves against the application force of the spring. Further, when the second guide portion 22 can be returned to a closed state under its own weight, the spring member can be omitted.

By the above-described configuration, first, when the opening/closing guide portion 20 is closed, as illustrated in FIG. 6A, the first guide portion 21 and the second guide portion 22 are maintained at a predetermined distance (3 mm) from the fixation guide portion 23. In addition, the second guide portion 22 is supported by the guide shaft 32*a* on the guide portion 32.

If the user raises the handle 28 and rotates the arms 29*a* and 29*b*, the opening/closing guide portion 20 deviates from the closing magnet 30. In addition, as illustrated in FIG. 6B, the arms 29*a* and 29*b* rotate around the rotation shafts 24*a* and 24*b* as the fulcrums in a counterclockwise direction, and are inclined in a direction where the first guide portion 21 is opened (direction away from the fixation guide portion 23). At this time, the abutted surface 22*c* of the second guide portion 22 is pressed upward by the bent portion 21*a* of the first guide portion 21.

As a result, the second guide portion 22 is maintained in a state where the second guide portion 22 is parallel to the fixation guide portion 23 while being guided to the guide shafts 32*a* and 32*b* of the supporting portion 32 and is slid in a direction away from the fixation guide portion 23. In addition, when the opening/closing guide portion 20 is maximally opened, the opening/closing guide portion 20 is absorbed into the opening and maintaining magnet 31 that is disposed to face the fixation guide portion 23, and the opened state thereof is maintained.

As such, since the second guide portion 22 moves in a direction away from the fixation guide portion 23, it is possible to improve visibility of the jammed sheet S, even though the rotation amount of the first guide portion 21 is not set to a large value. Further, even when the jammed sheet S is removed, the second guide portion 22 moves in a direction away from the fixation guide portion 23. Accordingly, a work space is ensured, and the sheet S can be easily removed.

Further, since the opening/closing guide portion 20 can be absorbed into the opening and maintaining magnet 31 and this state can be maintained, the user can perform a jam recovery using both hands, which results in improving work efficiency.

Further, since the arms 29*a* and 29*b* are formed to be bent, when the user inserts his or her hand from any one of both sides in the width-wise direction and performs a jam recovery, the user is not disturbed by the arms 29*a* and 29*b*. Accordingly, the user can easily remove the sheet S.

Further, since the second guide portion 22 moves to be substantially parallel to the fixation guide portion 23, it is possible to stably separate the second guide portion 22 without causing inconvenience in the separation operation, when the shape of the second guide portion 22 is complicated.

The present invention has been described on the basis of the first and second embodiments. However, the present invention is not limited thereto.

In the embodiments, the case where the horizontal path is opened has been described, but the present invention is not limited thereto. For example, the present invention may be applied to a vertical or inclined path.

In the embodiments, the downstream side of the sheet conveying direction of the opening/closing guide portion is opened, but the present invention is not limited thereto. The upstream side of the sheet conveying direction of the opening/closing guide portion or the side orthogonal to the sheet conveying direction may be opened.

In the embodiments, the force is applied to the second guide portion by the spring member (not illustrated), but the present invention is not limited thereto. In the horizontal path, the second guide portion may be biased downward under its own weight. Further, the force may be applied to the second guide portion in a direction where the second guide portion is returned to the closed state, by the spring member.

Further, in the embodiments, the electrophotographic image forming apparatus has been exemplified, but the present invention is not limited thereto. The present invention may be applied to image forming apparatuses that performs inkjet printing and offset printing.

While the present invention has been described with reference to exemplary embodiments, it is to be understood that the invention is not limited to the disclosed exemplary embodiments. The scope of the following claims is to be accorded the broadest interpretation so as to encompass all such modification and equivalent structures and functions.

This application claims the benefits of Japanese Patent Application No. 2008-139984, filed May 28, 2008, which is hereby incorporated by reference herein in its entirety.

What is claimed is:

1. A sheet conveying apparatus, comprising:

a fixation guide portion that is fixed on an apparatus body;

a first guide portion that is disposed to face the fixation guide portion;

a second guide portion that is disposed to face the fixation guide portion, wherein the first guide portion and the second guide portion are arranged in a line along a sheet conveying direction and each of the first guide portion and the second guide portion is independently movable;

a sheet conveying path formed by the fixation guide, the first guide portion and the second guide portion, and a movement mechanism that moves the second guide portion away from the fixation guide portion, when the first guide portion is moved to open the sheet conveying path.

2. The sheet conveying apparatus according to claim 1, further comprising:

arms that are supported by the apparatus body to rotate integrally with the first guide portion, and open/close the first guide portion, wherein the movement mechanism has a supporting portion that is provided on the arms and supports the second guide portion to rotate with respect to the arms, an abutment portion that is provided in one end portion of the second guide portion, and an abutted portion that is provided in the apparatus body and the abutment portion abuts, and when the abutment portion abuts the abutted portion while the first guide portion is opened by rotating the arms, the second guide portion is rotated around the supporting portion with respect to the arms, such that the other end portion of the second guide portion is moved in a direction away from the fixation guide portion.

3. The sheet conveying apparatus according to claim 1 wherein the first guide portion is rotated around a rotating center disposed on a first side in the sheet conveying direction, and when the first guide portion is rotated around the rotating center, the movement mechanism rotates the second guide portion so that a part of the second guide portion, that is arranged on the first side, moves away from the fixation guide portion.

4. The sheet conveying apparatus according to claim 1, wherein the movement mechanism comprises:

a guide abutment portion that is provided in the first guide portion;

a guide abutted portion that is provided in the second guide portion and the guide abutment portion abuts; and a guide portion that guides the second guide portion such that the second guide portion is slid in a direction away from the fixation guide portion, when the guide abutment portion abuts the guide abutted portion.

5. The sheet conveying apparatus according to claim 1, further comprising:

arms that are provided in the first guide portion, supported by the apparatus body to rotate integrally with the first guide portion, and open/close the first guide portion, wherein each of the arms has a fixing portion that is fixed to the first guide portion, and an extending portion that extends from the fixing portion, is bent in a direction away from the fixation guide portion, and is supported by the apparatus body to rotate.

6. A sheet conveying apparatus, comprising:

a first guide portion that guides a conveyed sheet;

a second guide portion that guides the same surface as a surface of the sheet that the first guide portion guides;

a holding portion that holds the first guide portion and the second guide portion;

a frame that supports the holding portion to rotate around a first rotating center; and an abutment portion that abuts the second guide portion, wherein the holding portion holds the second guide portion to rotate around a second rotating center, and in a course of rotating the holding portion, the first guide portion and the second guide portion integrally rotate around the first rotating center and the abutment portion abuts the second guide portion, and the abutment portion rotates the second guide portion around the second rotating center according to further rotating action of the holding portion around the first rotating center.

7. The sheet conveying apparatus according to claim 6, further comprising a fixation guide portion disposed to face the first guide portion and the second guide portion, wherein the first rotating center is disposed on a first side in the sheet conveying direction, and when the first guide portion is rotated around the rotating center, the abutment portion rotates the second guide portion so that a part of the second guide portion, that is arranged on the first side, moves away from the fixation guide portion.

8. The sheet conveying apparatus according to claim 6, further comprising a fixation guide portion that is fixed on an apparatus body and is disposed to face the first guide portion and the second guide portion wherein the holding portion has a fixing portion that is fixed to the first guide portion, and an extending portion that extends from the fixing portion, is bent in a direction away from the fixation guide portion, and is supported by the apparatus body to rotate.

9. A sheet conveying apparatus, comprising:

a fixation guide portion that is fixed on an apparatus body;

a first guide portion that is disposed to face the fixation guide portion;

a second guide portion that is disposed to face the fixation guide portion, wherein the first guide portion and the second guide portion are arranged in a line along a sheet conveying direction; and a frame that supports the first guide portion to freely rotate;

a slide supporting portion that supports the second guide portion to be slid so as to be away from the fixation guide portion; and a contact portion that is provided in the first guide portion, and contacts the second guide portion and slides the second guide portion according to rotating action of the first guide portion with respect to the frame.

10. The sheet conveying apparatus according to claim 9, further comprising:

arms that are provided in the first guide portion, supported by the apparatus body to rotate integrally with the first guide portion, and open/close the first guide portion, wherein each of the arms has a fixing portion that is fixed to the first guide portion, and an extending portion that extends from the fixing portion, is bent in a direction away from the fixation guide portion, and is supported by the apparatus body to rotate.

11. An image forming apparatus, comprising:

a fixation guide portion that is fixed on an apparatus body;

a first guide portion that is disposed to face the fixation guide portion;

a second guide portion that is disposed to face the fixation guide portion, wherein the first guide portion and the second guide portion are arranged in a line along a sheet conveying direction and each of the first guide portion and the second guide portion is independently movable;

a sheet conveying path formed by the fixation guide, the first guide portion and the second guide portion;

an image forming portion that forms an image on a sheet conveyed on the sheet conveying path; and a movement mechanism that moves the second guide portion away from the fixation guide portion, when the first guide portion is moved to open the sheet conveying path.

12. An image forming apparatus according to claim 11, further comprising:

arms that are supported by the apparatus body to rotate integrally with the first guide portion, and open/close the first guide portion, wherein the movement mechanism has a supporting portion that is provided on the arms and supports the second guide portion to rotate with respect to the arms, an abutment portion that is provided in one end portion of the second guide portion, and an abutted portion that is provided in the apparatus body and the abutment portion abuts, and when the abutment portion abuts the abutted portion while the first guide portion is opened by rotating the arms, the second guide portion is rotated around the supporting portion with respect to the arms, such that the other end portion of the second guide portion is moved in a direction away from the fixation guide portion.

13. An image forming apparatus according to claim 11, wherein the first guide portion is rotated around a rotating center disposed on a first side in the sheet conveying direction, and when the first guide portion is rotated around the rotating center, the movement mechanism rotates the second guide portion so that a part of the second guide portion, that is arranged on the first side, moves away from the fixation guide portion.

14. An image forming apparatus according to claim 11, wherein the movement mechanism comprises:

a guide abutment portion that is provided in the first guide portion;

a guide abutted portion that is provided in the second guide portion and the guide abutment portion abuts; and a guide portion that guides the second guide portion such that the second guide portion is slid in a direction away from the fixation guide portion, when the guide abutment portion abuts the guide abutted portion.

15. An image forming apparatus according to claim 11, further comprising:

arms that are provided in the first guide portion, supported by the apparatus body to rotate integrally with the first guide portion, and open/close the first guide portion, wherein each of the arms has a fixing portion that is fixed to the first guide portion, and an extending portion that extends from the fixing portion, is bent in a direction away from the fixation guide portion, and is supported by the apparatus body to rotate.

* * * * *